US007476123B2

(12) United States Patent
Kobayashi et al.

(10) Patent No.: US 7,476,123 B2
(45) Date of Patent: Jan. 13, 2009

(54) CONNECTOR WITH A CONNECTION DETECTOR HAVING AN OPERATING PLATE THAT IS PUSHED DURING CONNECTION

(75) Inventors: Yutaka Kobayashi, Yokkaichi (JP); Keiichi Nakamura, Yokkaichi (JP); Yutaka Noro, Yokkaichi (JP); Takahiro Kikuchi, Yokkaichi (JP); Yoshiyuki Ishikawa, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 0 days.

(21) Appl. No.: 11/998,587

(22) Filed: Nov. 30, 2007

(65) Prior Publication Data

US 2008/0132105 A1 Jun. 5, 2008

(30) Foreign Application Priority Data

Nov. 30, 2006 (JP) ..... 2006-323053

(51) Int. Cl.
*H01R 3/00* (2006.01)

(52) U.S. Cl. ..... 439/489; 439/352; 439/752

(58) Field of Classification Search ..... 439/489, 439/352, 752

See application file for complete search history.

(56) References Cited

U.S. PATENT DOCUMENTS

| | | | | |
|---|---|---|---|---|
| 5,647,757 | A * | 7/1997 | Chrysostomou | 439/352 |
| 6,102,732 | A | 8/2000 | Seko et al. | |
| 6,287,139 | B1 * | 9/2001 | Seko et al. | 439/489 |
| 6,383,021 | B1 * | 5/2002 | Murakami et al. | 439/587 |
| 6,824,417 | B1 | 11/2004 | Nimura | |
| 2003/0087548 | A1 | 5/2003 | Katsuma | |

* cited by examiner

*Primary Examiner*—Tho D Ta
(74) *Attorney, Agent, or Firm*—Gerald E. Hespos; Anthony J Casella

(57) ABSTRACT

A connector is provided with a housing (10) to be connected with a mating connector housing (70) upon receiving a pushing force from behind, and a slider (40) (connection detecting member) to be mounted into the housing (10) relatively movably between a standby position and a connection position. The slider (40) includes such an operating plate (41) as to entirely cover the rear end surface of the housing (10) at a position behind the rear end surface of the connector housing (10). If the operating plate (41) is pushed forward, a connecting operation of two housings (10, 70) proceeds and the slider (40) is moved from the standby position to the connection position.

11 Claims, 11 Drawing Sheets

CONNECTOR WITH A CONNECTION DETECTOR HAVING AN OPERATING PLATE THAT IS PUSHED DURING CONNECTION

BACKGROUND OF THE INVENTION

1. Field of the Invention

The invention relates to a connector.

2. Description of the Related Art

U.S. Pat. No. 6,824,417 discloses a connector with a housing that has a front end configured for connection with a mating connector housing. A connection detector is mounted in the housing and is movable between a standby position and a connection position. A lock arm is cantilevered back from the front end of the housing, and the connection detector is arranged at an upper side of the housing immediately behind the lock arm.

A connecting operation is carried out by pushing the rear end of the housing forward while the connection detector is at the standby position. The lock arm interferes with the mating housing during the connection process and is deformed. Additionally, the connection detector interferes with the deformed lock arm to prevent movement of the connection detector to the connection position. The lock arm restores resiliently and locks to the mating housing when the two housings are connected properly. Thus, the connection detector can move into a deformation space for the lock arm. The connection detector is brought to the connection position by pushing the rear end of the connection detector forward in the connecting direction. On the other hand, the lock arm remains deformed if the housings are not connected properly, thereby preventing the connection detector from being pushed to the connection position. According to this construction, the connected state of the housings can be detected based on whether the connection detector can be moved.

Proper connection of the two housings is guaranteed by the arrival of the connection detector at the connection position in such a connector. Thus, a movement of the connection detector has been essential.

However, in the above case, the connection detector must be moved independently of the connecting operation of the two housings. Therefore, there is a possibility of forgetting to move the connection detector.

The invention was developed in view of the above situation, and an object thereof is to ensure that movement of a connection detector cannot be forgotten.

SUMMARY OF THE INVENTION

The invention relates to a connector with a housing that is to be connected with a mating housing upon receiving a pushing force in a connecting direction. A connection detector is mounted in the housing and is movable between a standby position and a connection position. The connection detector can move from the standby position to the connection position only when the two housings are connected properly, and hence movement of the connection detector can detect a connected state of the two housings. The connection detector includes an operating plate behind the rear end surface of the housing and is moved from the standby position to the connection position by pushing the operating plate forward. The operating plate preferably covers not less than about 80% of the rear end surface of the housing, more preferably not less than about 90% of the rear end surface, and most preferably covers substantially entire the rear end surface of the housing. Thus, an operator is forced to carry out the connecting operation with the mating housing while pushing the rear end surface of the operating plate. The connection detector moves smoothly from the standby position to the connection position when the two housings are connected properly, as long as the operating plate is kept pushed.

An operator cannot forget to push the connection detector because the operating plate of the connection detector is pushed during the connection the two housings. Operational efficiency is better since the connecting operation of the two housings and the moving operation of the connection detector are carried out by one action of pushing the operating plate.

The housing preferably is formed with at least one cavity for receiving a terminal fitting. A mount hole is formed in a side surface of the housing adjacent to the rear end surface of the connector housing and can receive a retainer for retaining the terminal fitting in the cavity.

The connection detector preferably has at least one projecting plate adjacent to and continuous with the operating plate. The projecting plate partly or entirely covers a side surface of the housing adjacent to the rear end surface of the housing when the connection detector is at the connection position.

The projecting plate preferably partly or entirely closes the opening of the mount hole when the connection detector is at the connection position. Hence, the projecting plate can contact the retainer that has been inserted properly into the mount hole in a detaching direction of the retainer. Thus, an inadvertent detachment of the retainer from the mount hole can be prevented. Further, a retainer that is not inserted to a proper depth in the mount hole projects out through the opening of the mount hole and can interfere with the projecting plate of the connection detector during the movement towards the connection position. Therefore, whether the retainer is inserted to the proper depth in the mount hole can be detected based on whether the connection detector can be moved.

The projecting plate preferably surrounds the rear end of the housing on at least at three sides. Thus, operational efficiency is improved further by placing on the projecting plate a finger different from the finger placed on the rear end surface of the operating plate. Further, the movement of the connection detector is guided by the projecting plate while having loose movements thereof prevented.

The projecting plate preferably is substantially flush with and continuous with corresponding areas of the housing main body when the connection detector is positioned at the connection position.

The housing preferably comprises a lock arm being resiliently deformable and engageable with the mating housing to lock the properly connected housings. Additionally, the connection detector preferably comprises an auxiliary projecting plate to be inserted into a deformation space for the lock arm when the connection detector is at the connection position.

The auxiliary projecting plate preferably has a box shape with a base plate to be inserted in the deformation space for the lock arm. Lateral plates project from the base plate, and a covering plate bridges the upper ends of the lateral plates. The auxiliary projecting plate covers at least part of the lock arm when the connection detector is in the connecting position.

A forwardly open insertion space for the lock arm preferably is defined between the operating plate and the auxiliary projecting plate.

A restricting step extending in the width direction preferably is formed at an intermediate part of the lateral surface of the base plate substantially along the connecting direction. An area of the lateral surface of the base plate before the restricting step is slightly more inward than an area thereof behind the restricting step to a degree such that the thickness of the rear area is about twice that of the front area. A part of the base plate from the front area to the restricting step preferably serves as a receiving portion for receiving the free end of the lock arm, and a push-in movement of the connection detector into or onto the housing preferably is prevented by the contact of the free end of the lock arm with the restricting step.

The housing preferably comprises lateral engaging projections substantially adjacent to the lock arm. Slanted guiding surfaces are defined at the fronts of the engaging projections and are inclined with respect to the connecting direction, whereas restricting surfaces are defined at the rear of the engaging projection and are formed substantially normal to the connecting direction. Upon reaching the standby position, one or more engaging portions of the connection detector contact the respective engaging projections to prevent any further forward movement of the connection detector.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
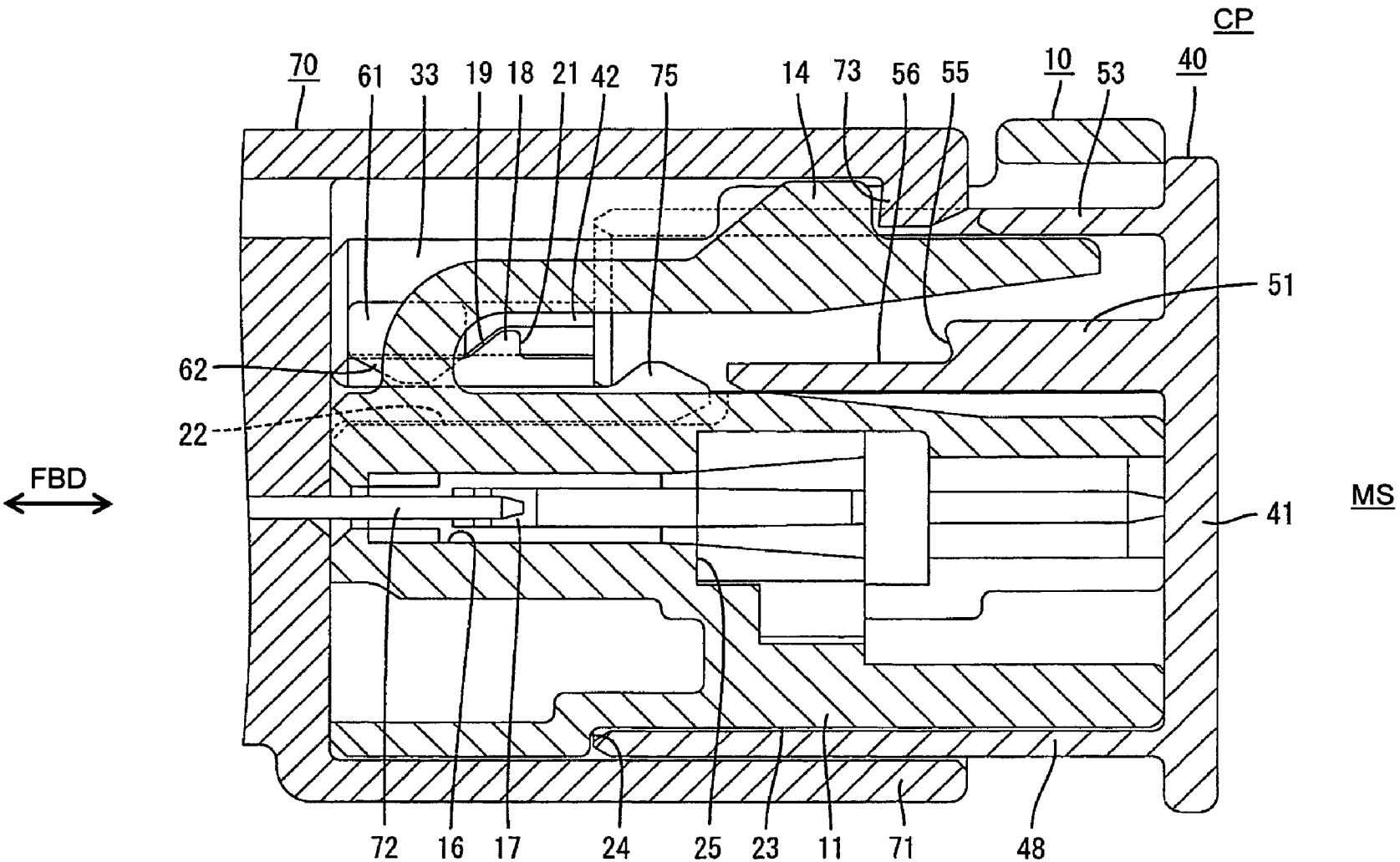
FIG. 1 is a side view in section showing a state where two connector housings are properly connected in one embodiment.

A connector in accordance with the invention includes a housing 10 and a mating housing 70 that are connectable with one another along a connecting direction CD, as shown in FIGS. 1 to 5. In the following description, the end of the housing 10 that is to be connected with the mating housing 70 is referred to as the front end concerning forward and backward directions FBD.

The mating housing 70 is made e.g. of a synthetic resin and includes a rectangular tubular receptacle 71 having an open front end. Tabs 72 of male terminal fittings are mounted to penetrate the back wall of the receptacle 71 and project into the inside of the receptacle 71. An interlocking portion 73 projects near the front end of a widthwise intermediate part of an inner surface of the receptacle 71. The receptacle 71 also includes left and right unlocking pieces 74 that project from the front surface of the back wall substantially in parallel with the tabs 72. The leading ends of the unlocking pieces 74 are more forward than leading ends of the tabs 72, and an unlocking part 75 having a pointed or mountain-shaped cross section projects near the leading end of each unlocking piece 74. The unlocking pieces 74 function to cancel a locked state of the retainer 90 with the connector housing 10.

The housing 10 is made e.g. of a synthetic resin, and includes a substantially block-shaped main body 11. A lock arm 12 cantilevers back from the front end of a widthwise intermediate part of the upper surface of the main body 11. A deformation space 13 is defined between the lower surface of the lock arm 12 and the upper surface of the main body 11. The deformation space 13 has a larger dimension in a height direction at the free end of the lock arm 12 than at the base end thereof. A lock projection 14 engageable with the interlocking portion 73 is provided at a longitudinal intermediate part of the upper surface of the lock arm 12. An arch 15 is provided on the corresponding upper surface of the main body 11 and surrounds the free end of the lock arm 12. Additionally, left and right protection walls 33 stand at the opposite sides of the lock arm 12 on the upper surface of the main body 11. The arch 15 and the protection walls 33 hinder an inadvertent deformation of the lock arm 12.

Cavities 16 are arranged in the width direction at one or more height levels inside the housing main body 11, and terminal fittings are insertable into the cavities 16 from behind. A resiliently deformable lock 17 is provided in each cavity 16, and engages the properly inserted terminal fitting to retain the terminal fitting in the cavity 16. The terminal fittings are female terminal fittings that are configured to receive the tabs 72. The terminal fittings are connected with ends of wires (not shown) that are drawn to the outside from the rear end surface RES of the main body 11. Left and right engaging projections 18 are provided on the upper surface of the main body 11 at opposite sides of the lock arm 12. Slanted guiding surfaces 19 are defined at the front of the engaging projections 18 and slope up and out towards the back with respect to the forward and backward directions FBD. However, restricting surfaces 21 are defined on the rear of the engaging projections 18 and are substantially normal to the forward and backward directions FBD. Slight recesses 22 are formed on the upper surface of the main body 11 inwardly of the engaging projections 18. The base end of the lock arm 12 is connected unitarily with the bottom surfaces of the recesses 22.

Figure 7:
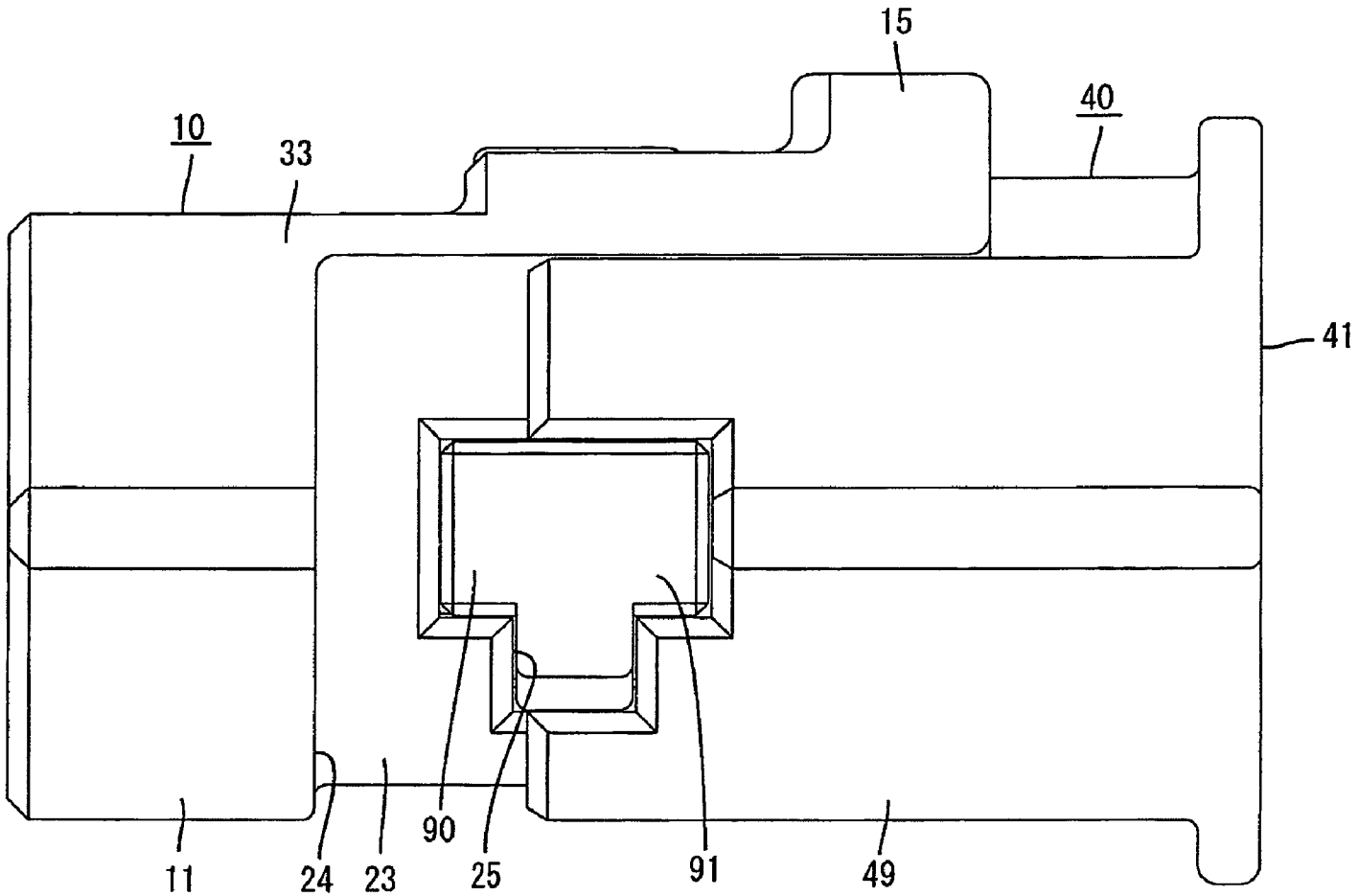
FIG. 7 is a side view of the connector with a slider at a standby position.

As shown in FIG. 7, outer side surfaces of the main body 11 are formed with a step 24 and a mounting recess 23 is formed in the outer side surfaces of the main body 11 in an area behind the step 24. The mounting recess 23 is formed over the opposite side surfaces and the bottom surface of the housing main body 11 to define a substantially U-shaped cross section. A mount hole 25 is formed in one side surface of the main body 11 for receiving a retainer 90. The mount hole 25 extends in the width direction with a depth sufficient to communicate with the cavities 16. The retainer 90 can be inserted to a proper depth into the mount hole 25 so that an operating surface 91 of the retainer 90 is substantially flush with the side surface of the main body 11 if the terminal fittings are inserted properly in the cavities 16. The retainer 90 then locks the properly inserted terminal fittings. On the other hand, any insufficiently inserted terminal fitting interferes with the retainer 90 and prevents the retainer 90 from being inserted completely into the mount hole 25. As a result the operating surface 91 projects out from the side surface of the main body 11.

Figure 9:
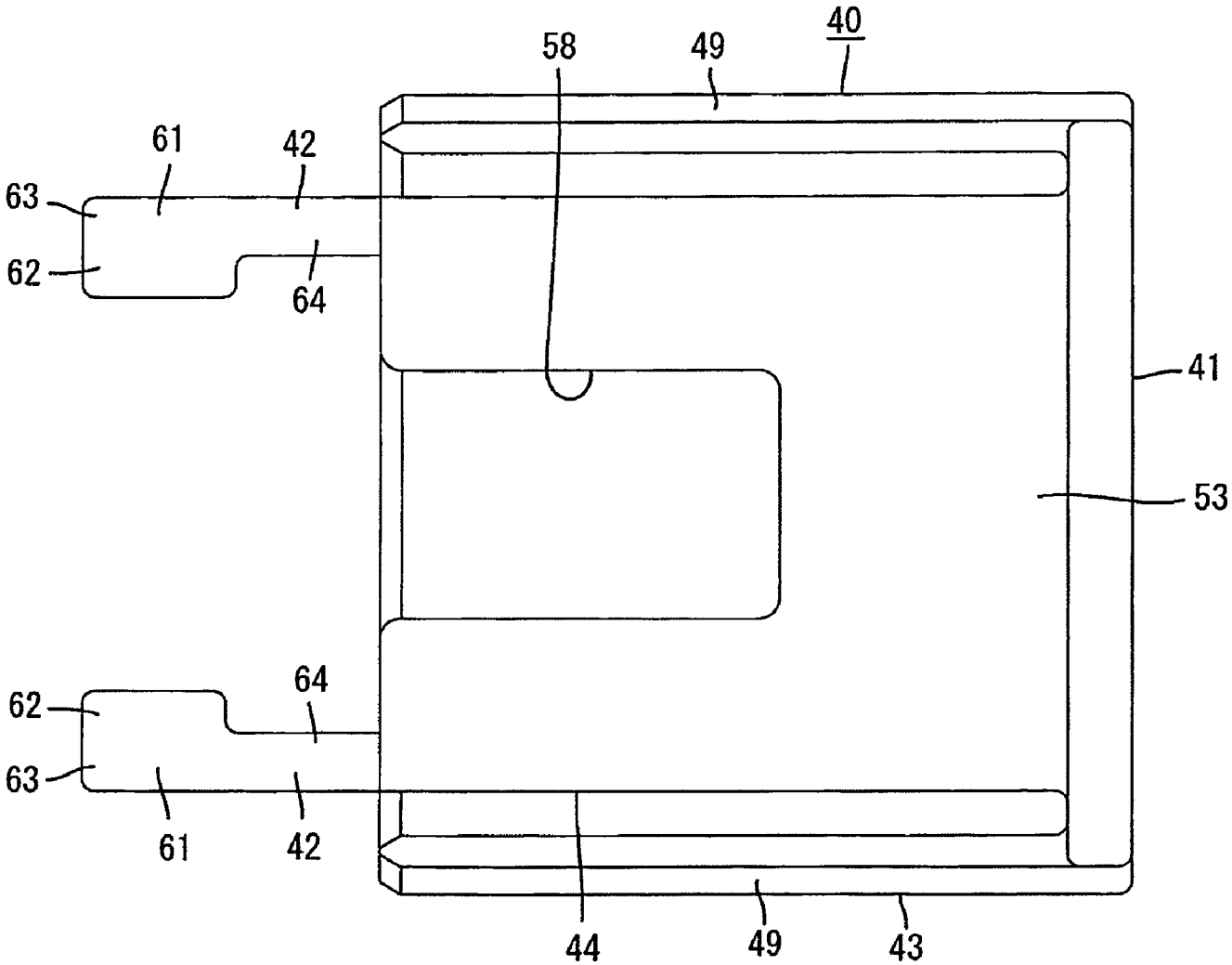
FIG. 9 is a plan view of the slider.
Figure 10:
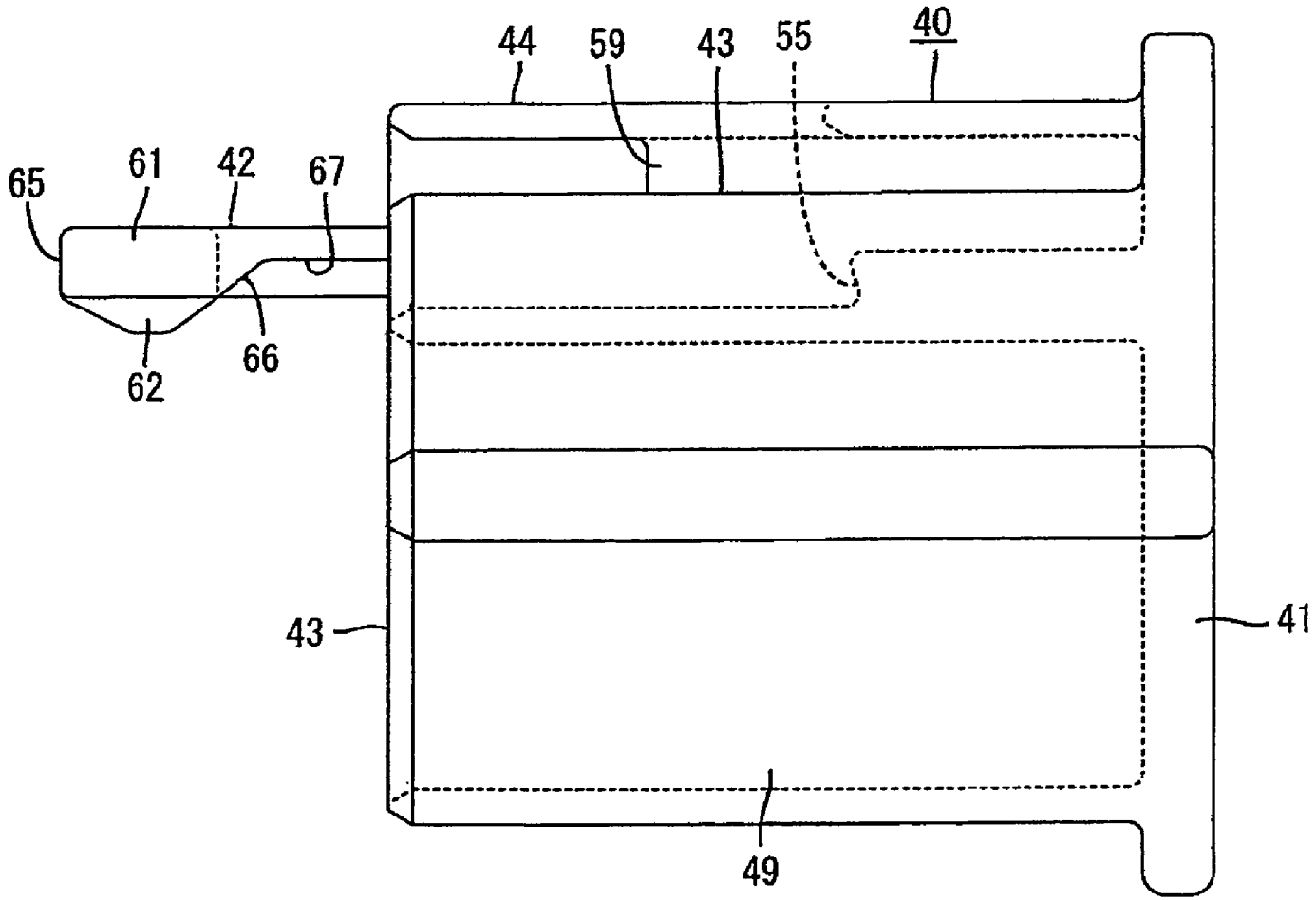
FIG. 10 is a side view of the slider.
Figure 11:
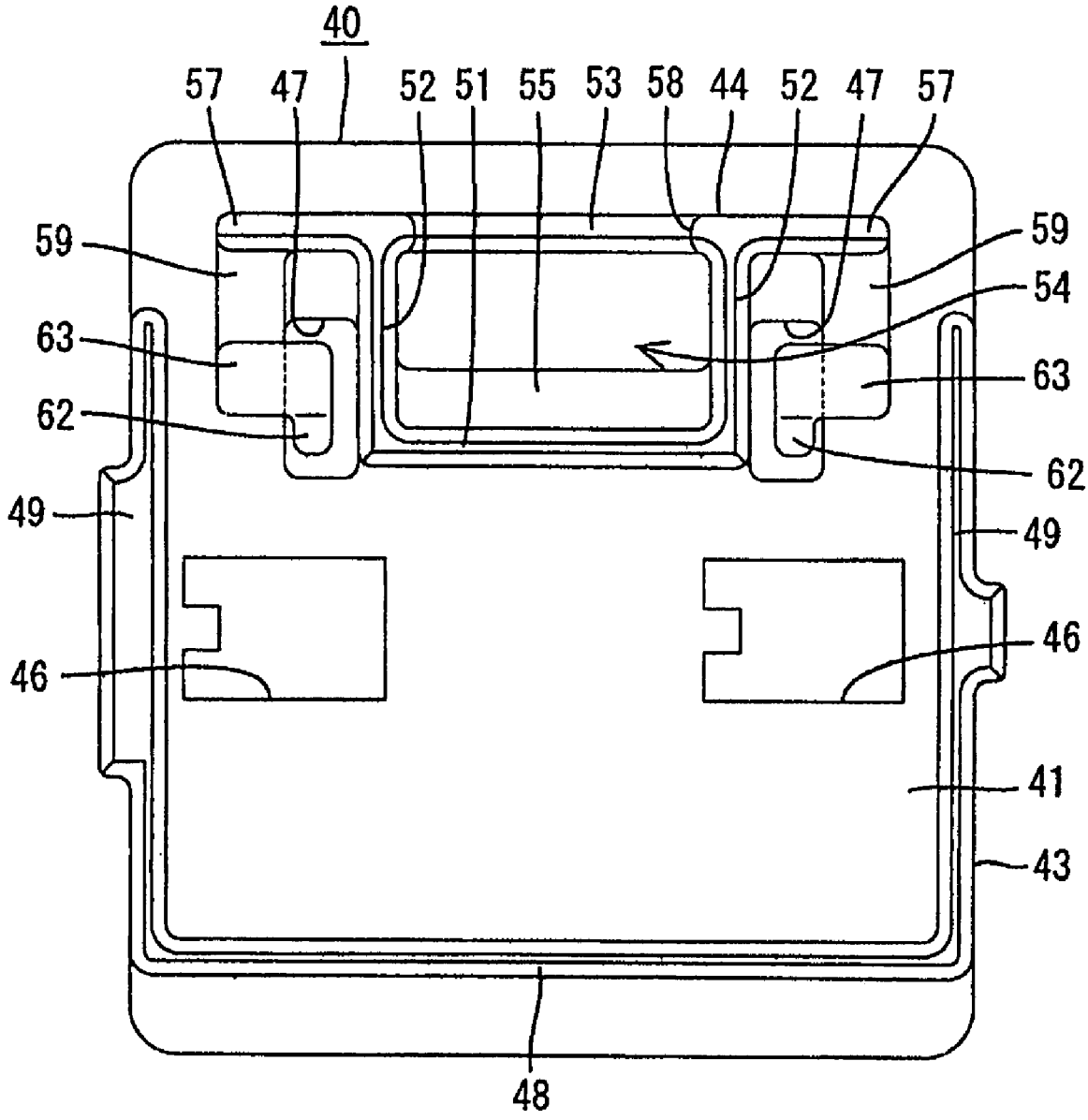
FIG. 11 is a front view of the slider.

The connector also has a cap-shaped slider 40 made e.g. of a synthetic resin. The slider 40 has an open front and is insertable into a mounting side MS at the rear of the housing 10, as shown in FIGS. 9 to 11. The slider 40 includes an operating plate 41 that extends substantially normal to the connecting direction CD. Left and right projecting pieces 42 project substantially horizontally forward along the connecting direction CD from the front surface of the operating plate 41. First and second projections 43, 44 also project forward from the front surface of the operating plate 41.

Figure 6:
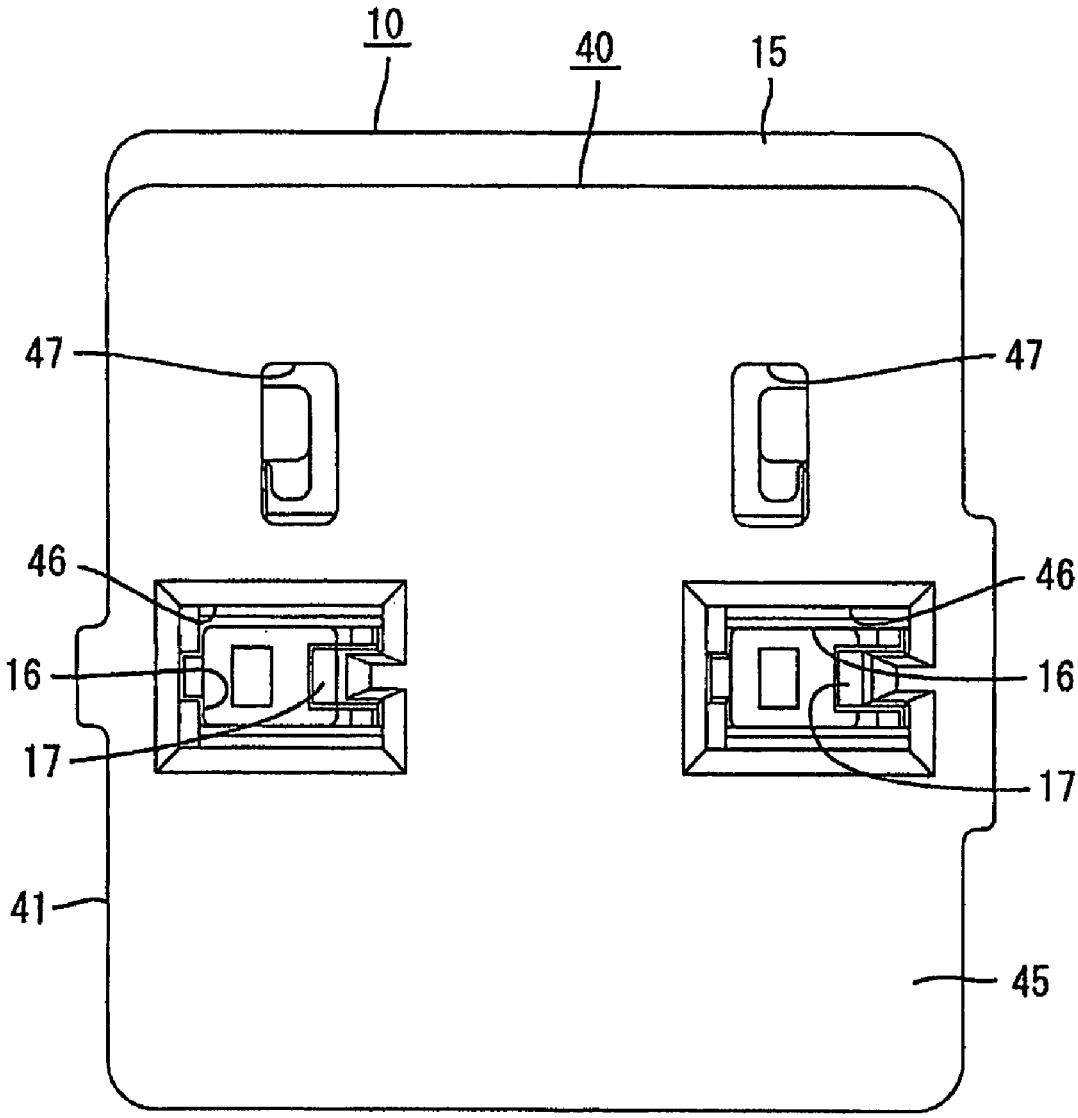
FIG. 6 is a rear view of a connector.

The operating plate 41 covers substantially the entire rear end surface RES of the housing 10 including the lock arm 12. More specifically, the operating plate 41 is substantially rectangular and has a rearwardly facing operating surface 45 at the backmost end of the entire connector when the slider 40 is mounted to the housing 10. As shown in FIG. 6, the operating plate 41 has left and right wire draw-out openings 46 at positions substantially corresponding to the cavities 16 of the main body 11 so that the wires can be drawn therethrough to the outside. Left and right mold removal openings 47 are left in an upper part of the operating plate 41 above the wire draw-out openings 46 upon removing a mold for forming the projecting pieces 42. Thus, the operating plate 41 covers substantially the entire rear end surface RES of the housing 10 except parts corresponding to the wire draw-out openings 46 and the mold removal openings 47.

The first projection 43 covers substantially the entire opposite side surfaces and the bottom surface of the housing main body 11 and the second projection 44 surrounds substantially the entire free end of the lock arm 12 while covering the upper surface of the main body 11. Thus, the projections 43, 44 surround the housing main body 11 at all four sides with respect to the height and width directions, i.e. the opposite side surfaces and the opposite upper and lower surfaces of the main body 11. The first projection 43 includes a bottom plate 48 and left and right side plates 49 standing up at right angles from the opposite ends of the bottom plate 48 and is formed unitarily to have a substantially U-shape. The first projection 43 is fit into the mounting recess 23 of the main body 11 as the slider 40 is mounted into the housing 10. More particularly, the first projection 43 is substantially flush with and continuous with areas of the opposite side surfaces and the bottom surface of the main body 11 before the step 24 when the slider 40 is fit to a connection position CP at a proper depth into the housing 10.

The second projection 44 has a substantially box shape with a base plate 51 to be inserted into the deformation space 13 for the lock arm 12, left and right standing plates 52 standing up substantially at right angles from opposite sides of the base plate 51, and a covering plate 53 substantially parallel to the base plate 51 while bridging the upper ends of the standing plates 52. A forwardly open box-shaped insertion space 54 is defined between the operating plate 41 and the second projection 44 for the lock arm 12.

The lower surface of the base plate 51 is arranged to contact the upper surface of the housing main body 11 and the upper surface of the base plate is arranged to contact the free end of the lock arm 12. A restricting step 55 extends in the width direction at a part of the base plate 51 approximately midway along the forward and backward directions FBD. Portions of the base plate 51 between the restricting step 55 and the operating plate 41 are approximately twice as thick as portions of the base plate 51 beyond the restricting step 55. A receiving portion 56 is defined along a part of the base plate 51 from the front end to the restricting step 55 and can receive the free end of the lock arm 12. A push-in movement of the slider 40 into the housing 10 is prevented by contact of the free end of the lock arm 12 with the restricting step 55. The standing plates 52 face the opposite side surfaces of the free end of the lock arm 12, and the projecting pieces 42 are arranged at the outer lateral sides of the standing plate 52.

The covering plate 53 covers substantially all of the upper side of the free end of the lock arm 12 while defining the upper part of the insertion space 54 and juts out laterally beyond the standing plates 52. Left and right jutting ends 57 of the covering plate 53 substantially entirely cover the projecting pieces 42 from above. A forwardly open U-shaped cutout 58 is formed in a widthwise intermediate part of the covering plate 53 for receiving the lock projection 14 of the lock arm 12 and the mating interlocking portion 73 when the slider 40 is inserted into the housing 10 to the proper depth.

The projecting pieces 42 are narrow and long along the connecting direction CD of the housing 10, and leading ends of the projecting pieces are exposed at positions more forward than the leading ends of the projections 43, 44. The projecting pieces 42 are connected with two reinforcing plates 59 that extend down from the lower surfaces of the opposite jutting ends 57 of the covering plate 53 from the base ends of the projecting pieces 42 at the operating plate 41 to intermediate positions. Additionally, the projecting pieces 42 are resiliently deformable in directions intersecting the connecting direction CD with the front ends of the reinforcing plates 59 as supports.

Engaging portions 61 are provided at the leading ends of the projecting pieces 42 and are engageable with the engaging projections 18 of the housing 10 and the mating unlocking parts 75. The opposite widthwise sides of each engaging portion 61 are divided into an unlocking area 62 engageable with the unlocking part 75 and a movement restricting area 63 engageable with the engaging projection 18. The movement restricting area 63 is at the outer side and has substantially the same width as an arm 64 of the corresponding projecting piece 42. The unlocking area 62 is at the inner side and juts out laterally beyond the arm 64. A restriction receiving surface 65 extends substantially vertically at the front end of the movement restricting area 63 and contacts the restricting surface 21 of the engaging projection 18. A guide receiving surface 66 is at the rear end of each movement restricting area 63 and inclines obliquely back for sliding contact with the guiding surface 19 of the engaging projection 18. A groove 67 is formed in a part of each projecting piece 42 behind the guide receiving surface 66 of the movement restricting area 63 and extends in the connecting direction CD of the housing 10. The unlocking areas 62 project down with a pointed or mountain-shaped cross section, and the lower surfaces thereof are located lower than those of the movement restricting areas 63. It should be noted that the mold removal openings 47 of the operating plate 41 are formed as the unlocking areas 62 are formed.

The slider 40 is movable between a standby position SP (FIG. 2) and a connection position CP (FIG. 1). The restriction receiving surfaces 65 of the movement restricting areas 63 contact the restricting surfaces 21 of the engaging projections 18 to prevent forward movement of the slider 40 from the standby position SP before the housings 10, 70 are connected. Additionally, the operating plate 41 is spaced rearward from the rear end surface RES of the housing 10 when the slider 40 is in the standby position SP. However, the slider 40 can be moved forward to the connection position CP after the housings 10, 70 have been connected properly. More particularly, at the connection position CP, the movement restricting areas 63 move forward past the engaging projections 18, and the guide receiving surfaces 66 of the movement restricting areas 63 and the guiding surfaces 19 of the engaging projections 18 are in contact with each other. Thus, the operating plate 41 is substantially in contact with the rear end surface RES of the housing 10.

The connector is assembled by inserting the terminal fittings connected with the wires into the housing 10. Additionally, the wires are inserted through the wire draw-out openings 46 of the operating plate 41 to hang the slider 40 at an intermediate position with respect to an extending direction of the wires. The slider 40 then is mounted forwardly from a mounting side MS into the housing 10. Thus, the first projecting plate 43 is inserted on the rear end of the housing main body 11 while being held in sliding contact with the wall surface of the mounting recess 23. Additionally, the lock arm 12 is inserted into the insertion space 54 of the second projecting plate 44 with the free end of the second projecting plate 44 heading forward. Upon reaching the standby position SP, the movement restricting areas 63 of the engaging portions 61 contact the engaging projections 18 to prevent any further forward movement of the slider 40.

Figure 2:
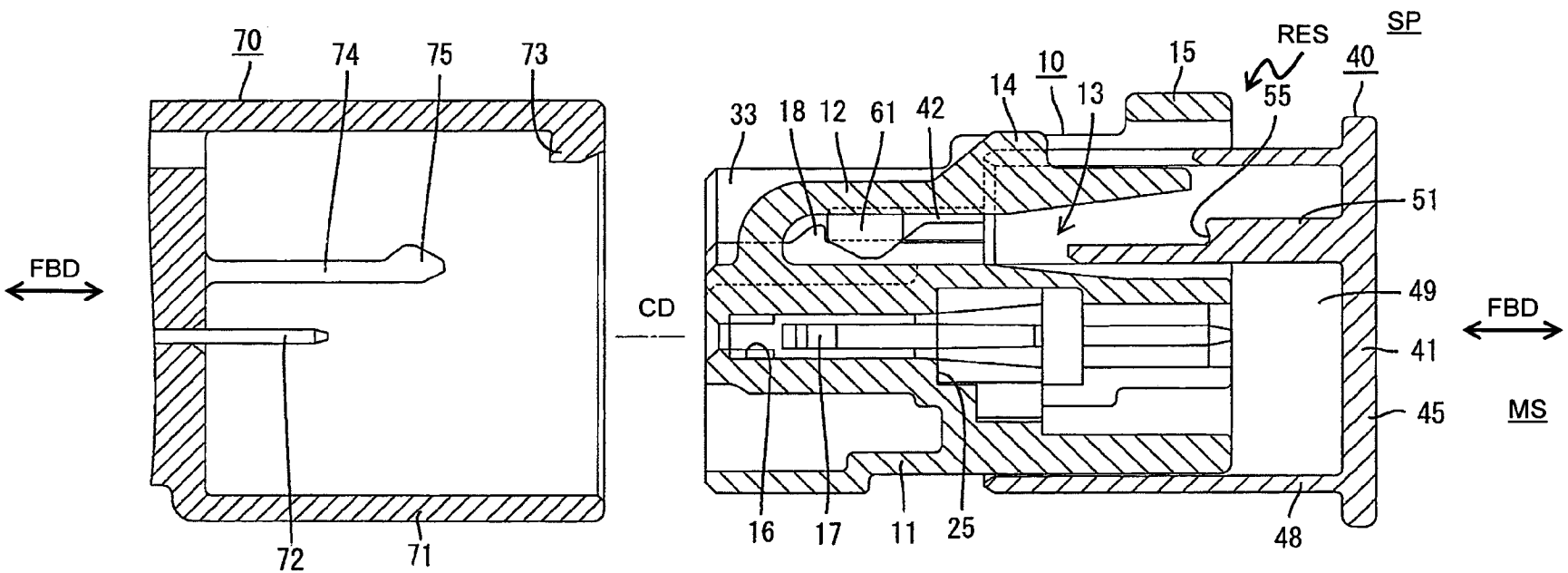
FIG. 2 is a side view in section showing a state before the two housings are connected.
Figure 3:
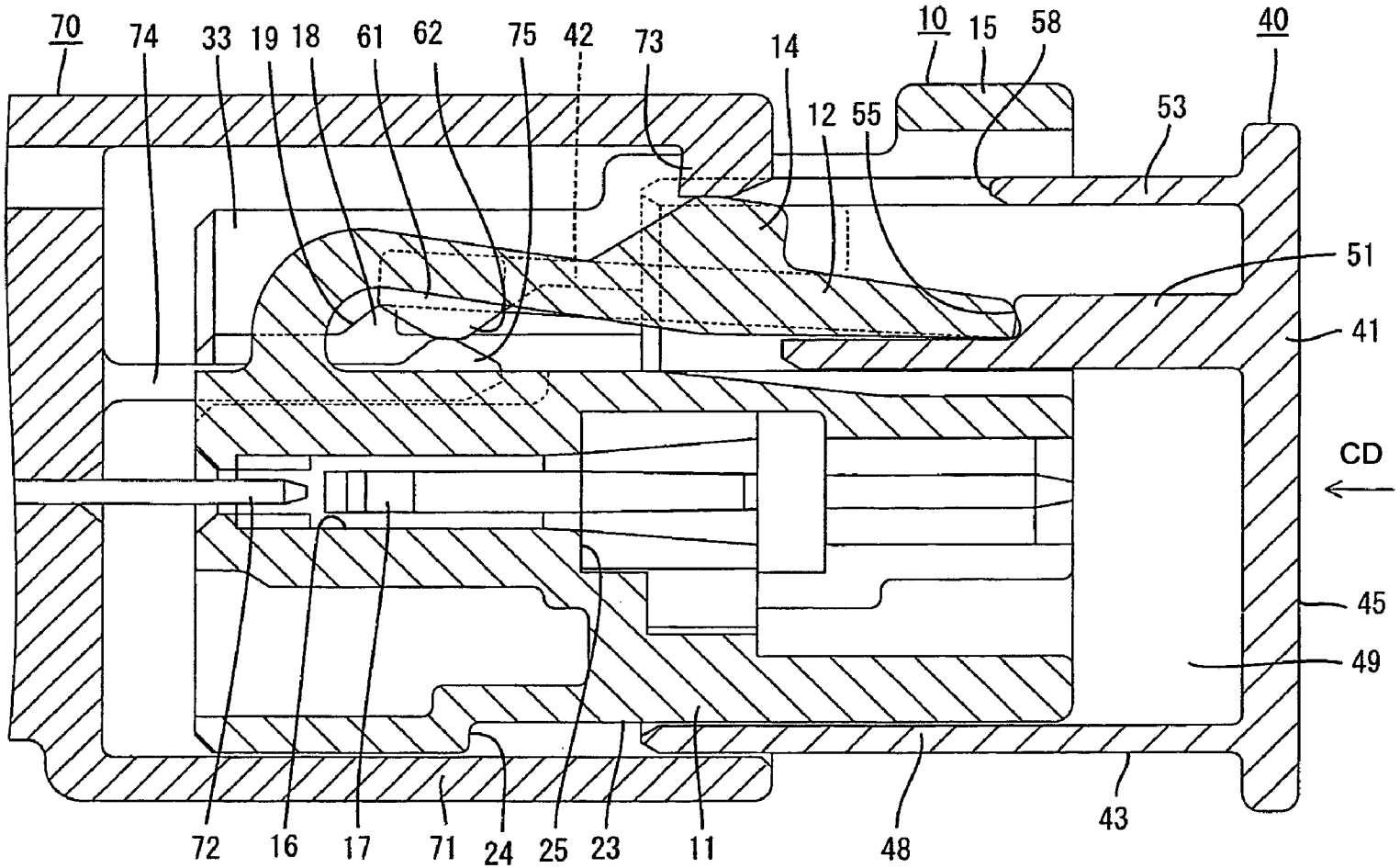
FIG. 3 is a side view in section showing an intermediate state of a connecting operation of the two housings.

Subsequently, as shown in FIG. 2, the housing 10 is positioned opposed to the mating housing 70 and the connecting surfaces of the two housings 10, 70 are brought into contact. The backmost end of the connector then is pushed from behind in the connecting direction CD in FIG. 3 with a pushing force acting towards the mating connector housing 70. Here, the rear end surface RES of the housing 10 is substantially entirely covered by the operating plate 41 of the slider 40. Thus, an operator can only push the operating surface 45 of the operating plate 41. The operator places one finger on the operating surface 45 of the operating plate 41 and another finger on the outer surface of the first projecting plate 43 and pushes the operating plate 41 forward so that the housing 10 enters the mating receptacle 71.

The lock projection 14 interferes with the mating interlocking portion 73 in an intermediate stage of the connection of the two housings 10, 70 and deforms the lock arm 12 towards the deformation space 13. Substantially simultaneously, the unlocking areas 62 of the engaging portions 61 of the projecting pieces 42 interfere with the unlocking parts 75 of the mating unlocking pieces 74. As a result, the projecting pieces 42 are deformed and disengage from the engaging projections 18. On the other hand, the free end of the resiliently deformed lock arm 12 enters the receiving portion 56 and contacts the restricting step 55. Consequently, the slider 40 cannot move forward even though the engaging portions 61 of the projecting pieces 42 are disengaged from the engaging projections 18.

Figure 4:
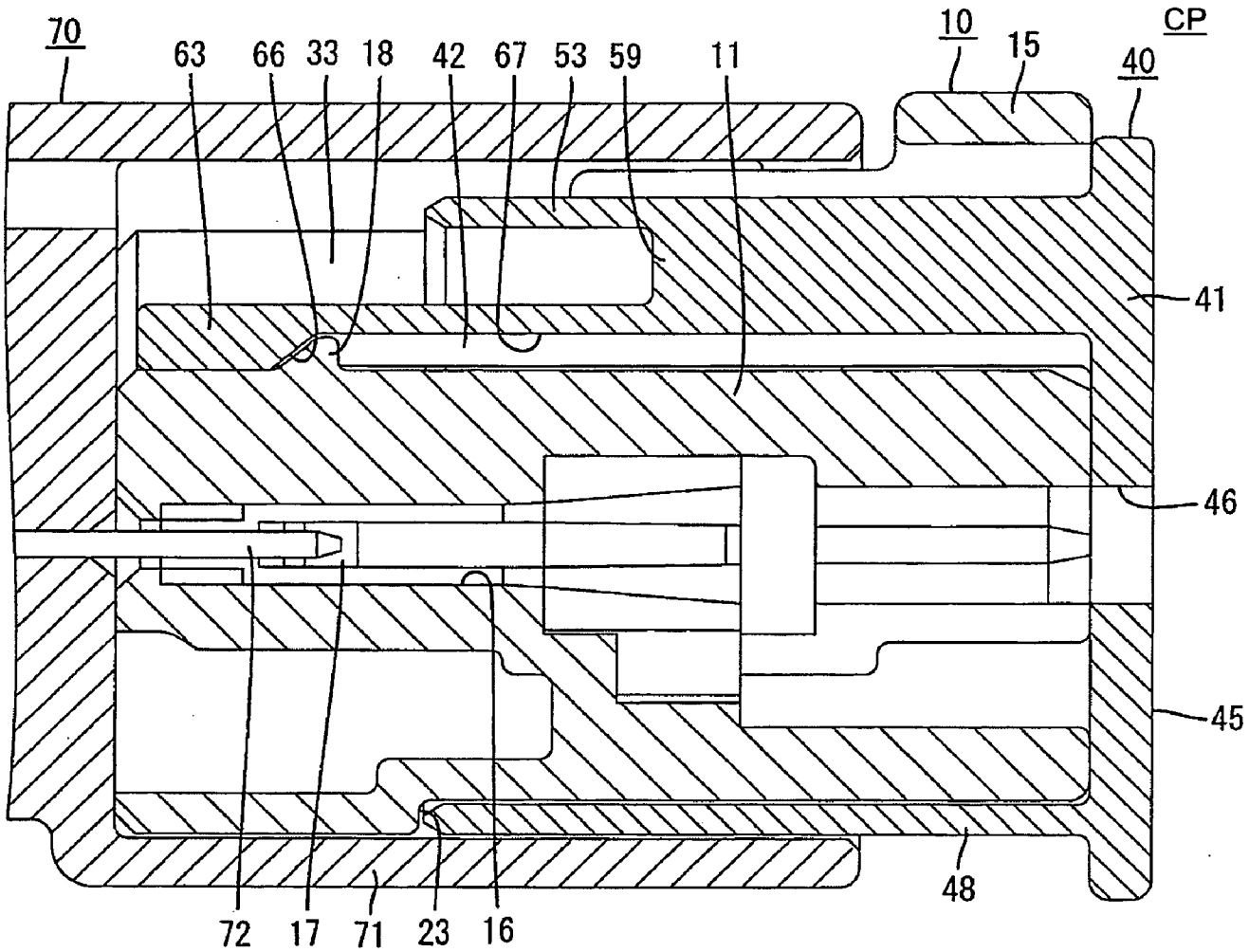
FIG. 4 is a side sectional view showing an engaging state of an engaging portion and an engaging projection when the two housings are connected properly.
Figure 5:
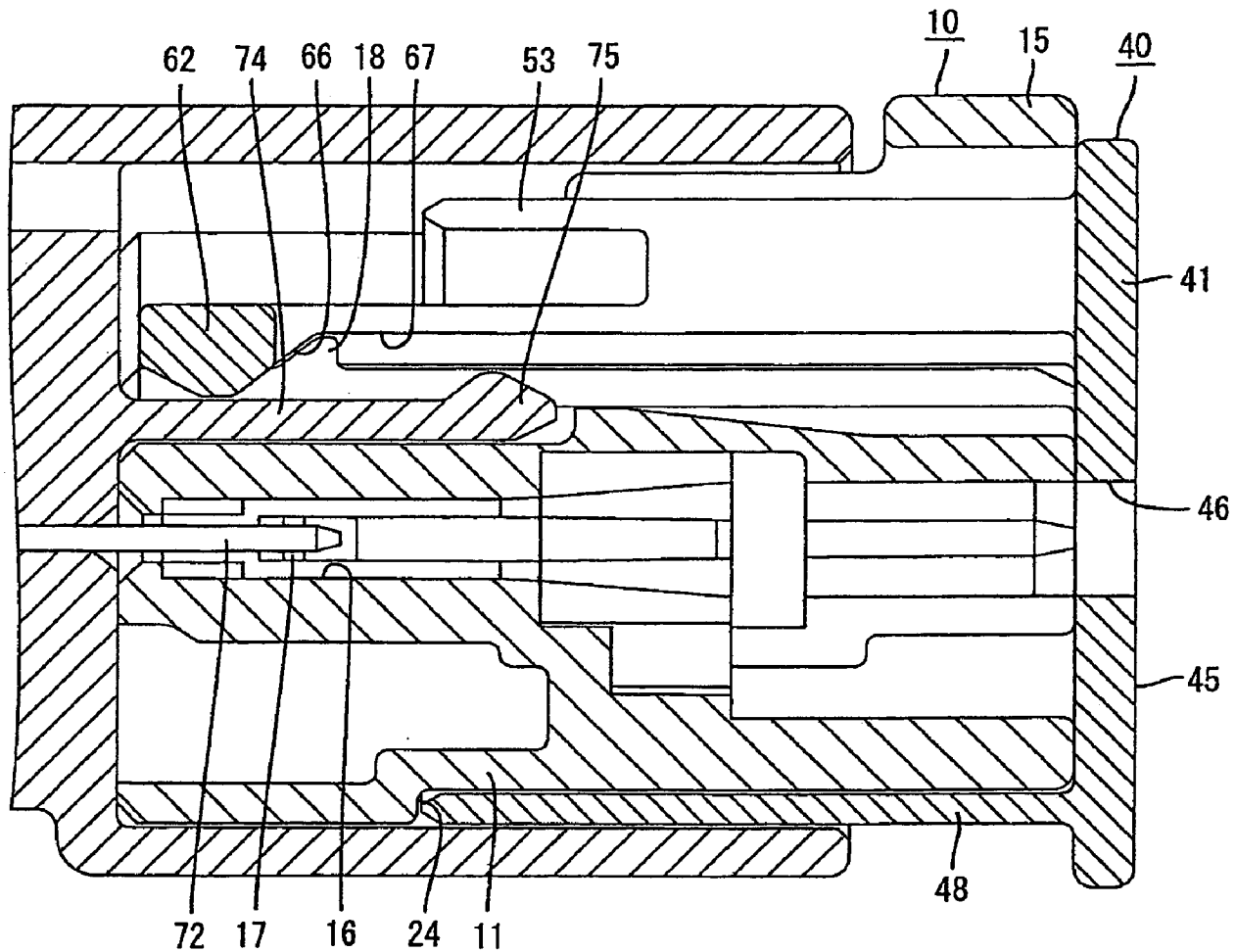
FIG. 5 is a side view in section showing an unlocking piece and a projecting piece when the housings are connected properly.

The engaging portions 61 of the projecting pieces 42 pass the unlocking parts 75 of the unlocking pieces 74 when the two housings 10, 70 are connected properly. At this time, the lock arm 12 is restored resiliently to disengage the receiving portion 56 and to engage the interlocking portion 73. As a result, the two housings 10, 70 are locked in their connected state with the male and female terminal fittings connected electrically to proper depths. The slider 40 is permitted to move forward relative to the housing 10 as the lock arm 12 returns. Thus, the slider 40 automatically reaches the connection position CP if the operating plate 41 is kept pushed. The engaging portions 61 of the projecting pieces 42 move past the engaging projections 18 at the connection position CP and restore resiliently. Additionally, the guide receiving surfaces 66 of the engaging portions 61 and the guiding surfaces 19 of the engaging projections 18 face each other in a backward moving direction of the slider 40, as shown in FIGS. 1 and 4.

Figure 8:
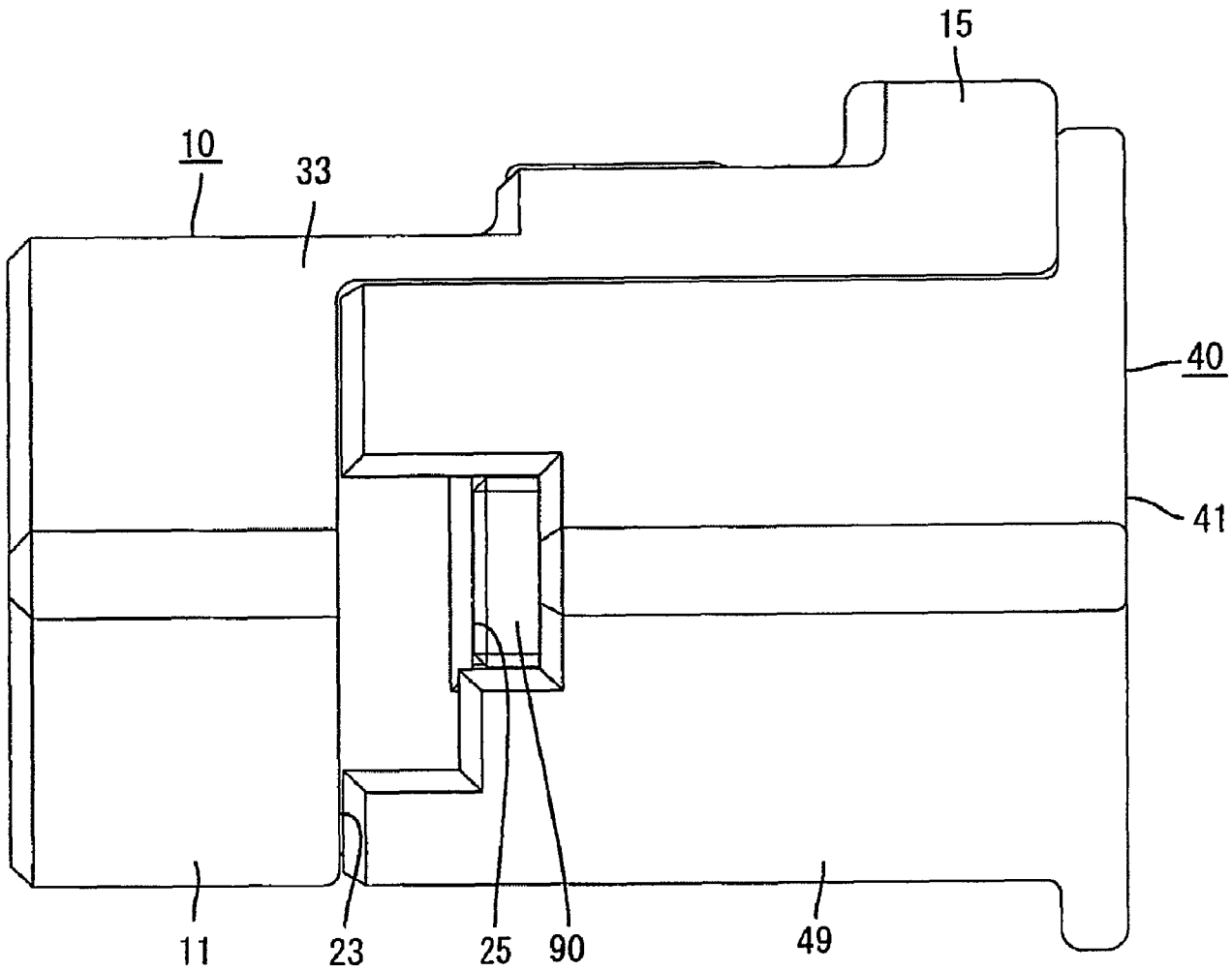
FIG. 8 is a side view of the connector when the slider is at a connection position.

The side plate 49 of the first projection 43 partly closes the mount hole 25 in the side surface of the housing 10 when the two housings 10, 70 are connected properly, as shown in FIG. 8. Accordingly, the side plate 49 faces the retainer 90 in the mount hole 25 and in a detaching direction of the retainer 90. As a result, the retainer 90 cannot be detached from the mount hole 25. The rear end of the retainer 90 will interfere with the front end of the side plate 49 if the retainer 90 has not be inserted to a proper depth into the mount hole 25, thereby preventing movement of the slider 40 to the connection position CP. Thus, an insufficient insertion of the retainer 90 into the mount hole 25 can be detected based on inability to move the slider 40 to the connecting position CP.

A force can be exerted to separate the housings 10, 70 while the free end of the lock arm 12 is pushed in an unlocking direction. As a result, the guide receiving surfaces 66 of the engaging portions 61 and the guiding surfaces 19 of the engaging projections 18 slide in contact with each other, and the two housings 10, 70 are separated smoothly. On the other hand, if the two housings 10, 70 are left partly connected, the free end of the lock arm 12 remains in contact with the restricting step 55 of the receiving portion 56 due to the interference with the interlocking portion 73. Thus, a forward movement of the slider 40 along the connecting direction CD and towards the housing 10 is prevented and the operating plate 41 is distanced from the rear end surface RES of the housing 10. This partly connected state of the two housings 10, 70 can be known if this state can be confirmed visually (e.g. by the eyes or by a camera, sensor or the like). Thus, the housing 10 is pushed deeply towards the mating housing 70 to reach a properly connected state.

As described above, the rear end surface RES of the housing 10 is covered at least partly by the operating plate 41 of the slider 40 (preferably not less than about 80%, more preferably not less than about 90% of the rear end surface RES of the connector housing 10 is covered by the operating plate 41). Thus, the operator is forced to carry out the connecting operation with the mating housing 70 while pushing the operating surface 45 of the operating plate 41. In other words, there is no likelihood of forgetting the operation of moving the slider 40 since the slider 40 is not pushed in after the connecting operation of the two housings 10, 70 is completed. Further, operability is better since the connecting operation of the two housings 10, 70 and the moving operation of the slider 40 are carried out simultaneously by one action of pushing the operating plate 41 as the slider 40 is operated in a direction substantially parallel to the connecting direction CD.

The first and second projections 43, 44 substantially surround the rear end of the housing 10. Therefore, operability is improved by placing one finger on the rear end surface RES of the operating plate 41 and another on the first projection 43. Furthermore, movement of the slider 40 relative to the housing 10 is guided by the projections 43, 44 to prevent loose movements.

The invention is not limited to the above described and illustrated embodiment. For example, the following embodiments are also embraced by the technical scope of the present invention as defined by the claims.

The disclosed movement permitting means of the slider can be replaced by the movement permitting means of a known slider (detector) for permitting movement from the standby position SP to the connection position CP only when the housings are connected properly.

According to the invention, it is sufficient for the slider to include the operating plate, and part or all of the projections may be omitted.

According to the invention, it is sufficient for the projection to be positioned to partly or entirely close at least the mount hole.

The projecting plate may surround the rear end of the housing at three sides and the covering by the second projection may be omitted.

The operating plate may close the mold removal openings.

The invention is also applicable in the case where a slider is mounted into a male connector housing accommodating male terminal fittings.

What is claimed is:

1. A connector, comprising:

a housing having opposite front and rear ends spaced apart along a connecting direction, the housing being configured to be connected with a mating housing upon receiving a pushing force in the connecting direction, and a connection detector to be mounted to the rear end of the housing for movement along the connecting direction between a standby position and a connection position, the connection detector being configured to be moved from the standby position to the connection position only when the two housings are connected properly, wherein:

the connection detector includes an operating plate behind a rear end surface of the housing and being movable from the standby position to the connection position by pushing the operating plate forward along the connecting direction as the housing is being connected with the mating housing, and the operating plate is formed to cover not less than about 80% of the rear end surface of the housing.

2. The connector of claim 1, wherein the housing is formed with at least one cavity for receiving at least one terminal fitting, and a mount hole is formed in a side surface of the housing adjacent to the rear end surface of the housing for receiving a retainer for retaining the terminal fitting in the cavity.

3. The connector of claim 1, wherein when the connection detector is positioned at the connection position, the projection is substantially flush with and continuous with corresponding areas of a main body of the housing.

4. A connector, comprising:

a housing to be connected with a mating housing upon receiving a pushing force in a connecting direction, the housing being formed with at least one cavity for receiving at least one terminal fitting, the housing further having a rear end surface and a mount hole formed in a side surface of the housing adiacent to the rear end surface for receiving a retainer to retain the terminal fitting in the cavity, and a connection detector to be mounted to the housing for movement between a standby position and a connection position, the connection detector being configured to be moved from the standby position to the connection position only when the two housings are connected properly, the connection detector includes an operating plate behind a rear end surface of the housing and being movable from the standby position to the connection position by pushing the operating plate forward, the operating plate being formed to cover not less than about 80% of the rear end surface of the housing, wherein the connection detector includes at least one projection adjacent to and continuous with the operating plate, the projection covering at least part of a side surface of the housing adjacent to the rear end surface of the housing with the connection detector at the connection position.

5. The connector of claim 4, wherein the projection at least partly closes the opening of the mount hole with the connection detector at the connection position for contacting the retainer properly inserted into the mount hole in a detaching direction of the retainer.

6. The connector of claim 5, wherein the projection surrounds the rear end of the housing at least at three sides.

7. A connector comprising:

a housing to be connected with a mating housing upon receiving a pushing force in a mating direction, the housing comprises a resiliently deformable lock arm configured for engaging the mating housing to lock the properly connected housings, and a connection detector to be mounted to the housing for movement between a standby position and a connection position, the connection detector being configured to be moved from the standby position to the connection position only when the two housings are connected properly, the connection detector including an operating plate behind a rear end surface of the housing and being movable from the standby position to the connection position by pushing the operating plate forward, the operating plate being formed to cover not less than about 80% of the rear end surface of the housing wherein the connection detector comprises an auxiliary projecting plate to be inserted into a deformation space for the lock arm with the connection detector at the connection position.

8. The connector claim 7, wherein the auxiliary projecting plate substantially has a box shape defined by a base plate to be inserted into the deformation space for the lock arm, lateral standing plates projecting from the base plate, and a covering plate bridging upper ends of the standing plates, wherein the auxiliary projecting plate substantially entirely covers the lock arm with the connection detector positioned in the connecting position.

9. The connector of claim 8, wherein a space having an open front side and defined between the operating plate and the auxiliary projecting plate serves as an insertion space for the lock arm.

10. The connector of claim 8, wherein a restricting step extends in width direction at an intermediate part of the lateral surface of the base plate substantially along the connecting direction, and an area of the lateral surface of the base plate before the restricting step is more inward than an area thereof behind the restricting step to such a degree that a thickness of the rear area is about twice that of a front area, a part of the base plate from the front area to the restricting step defining a receiving portion for receiving the free end of the lock arm, and a push-in movement of the connection detectorinto the housing is prevented by contact of the free end of the lock arm with the restricting step.

11. A connector comprising:

a housing to be connected with a mating housing upon receiving a pushing force in a connecting direction, the housing being formed with at least one cavity for receiving at least one terminal fitting, the housing comprises a resiliently deformable lock arm configured for engaging the mating housing to lock the properly connecting housings, two lateral engaging projections substantially adjacent to the lock arm, wherein front surfaces of the engaging projectionsare formed into slanted guiding surfaces inclined with respect to the connecting direction, whereas the rear surfaces thereof are formed into restricting surfaces arranged substantially normal to the connecting direction, and a connection detector to be mounted to the housing for movement between a standby position and a connection position, the connection detector being configured to be moved from the standby position to the connection position only when the two housings are connected properly, the connection detector including an operating plate behind a rear end surface of the housing and being movable from the standby position to the connection position by pushing the operating plate forward, the operating plate being formed to cover not less than about 80% of the rear end surface of the housing, wherein upon reaching the standby position, engaging portions of the connection detector contact the respective engaging projections to prevent any further forward movement of the connection detector.

* * * * *